United States Patent [19]

Robinson

[11] 4,241,885

[45] Dec. 30, 1980

[54] REVERSIBLE TOILET PAPER HOLDER

[76] Inventor: Gene P. Robinson, 4661 Larson Way, Sacramento, Calif. 95822

[21] Appl. No.: 35,326

[22] Filed: May 2, 1979

[51] Int. Cl.[3] ..... B65H 19/02

[52] U.S. Cl. ..... 242/55.2

[58] Field of Search ..... 242/55.2, 55.3, 55.54, 242/55.53; 248/447, 454, 479, 214, 217.2, 222.3, 257, 297

[56] References Cited

U.S. PATENT DOCUMENTS

| | | | |
|---|---|---|---|
| 1,687,819 | 10/1928 | Worthington | 242/55.2 |
| 3,162,390 | 12/1964 | Meyer | 242/55.54 |
| 3,227,386 | 1/1966 | Pitcher | 242/55.2 |

*Primary Examiner*—Stanley N. Gilreath

[57] ABSTRACT

A holder for dispensing rolled material, such as toilet paper, supporting the roll on a turntable so that the direction of unrolling of the paper or other material can be readily reversed without necessitating removal of the roll from its mounting by rotating the turntable one-hundred-eighty degrees, thus reversing the rolled material end-for-end.

6 Claims, 12 Drawing Figures

REVERSIBLE TOILET PAPER HOLDER

SUMMARY

The invention pertains generally to holders for dispensing of rolled materials, such as paper, and particularly to holders for rolled toilet paper. The invention has as an object the provision by means of a turntable, for ready reversal of the roll without necessitating removal of the roll, as a means of satisfying user preference or need for unrolling the roll from either the top outward or from the back downward, especially where the roll is not changed or replaced each time a different user uses it, a provision not made in the current state of the art.

A second object of the invention is to provide a pushbutton latch which positions the turntable into one of two potential dispensing positions. The button is depressed to release the turntable on which the roll is mounted and, when rotation has been dialed one hundred-eighty degrees, the button pops up to latch the turntable in the new position.

A third object of the invention is to provide for ease of production and strong, simplified installation by utilizing only three basic parts of molded plastic, die-cast metal, pressed metal or combinations thereof which are readily assembled and mounted for use, with the part which retains the assembly onto the mounting surface imparting maximum strength to the turntable by holding it at its perimeter.

A fourth object of the invention is to provide for mounting either onto a flat surface, such as a wall, or into a niche if depressed mounting is desired.

DESCRIPTION

The primary purpose of the invention is to provide a means for reversing the direction in which the rolled material is unrolled as it is dispensed, without necessitating the removal of the roll from its mounting. The invention is manufactured in three separate pieces which are assembled at the time of installation and mounted by means of screws or other suitable fasteners on to a wall or other surface as desired. The reversing motion is accomplished by rotation of a turntable having the supporting arms for the rolled material molded or die cast as integral parts of the turntable. Two holes in the turntable centered one-hundred-eighty degrees apart in the plane of rotation serve as latch catches, stopping rotation of the turntable as one comes to rest over a pushbutton on a flexible, springy arm in the supporting piece of the invention mounted beneath the turntable. The supporting piece also provides a bearing hole in which the spindle of the turntable revolves. The support and turntable pieces can be manufactured in either of two styles for mounting onto a flat surface or into a recess, as will be seen in the drawings. With either style, both pieces are secured in place by a third piece, which has a large center hole to permit freedom of access to the rolled material and turntable, yet imparts great strength of assembly by lapping over the outer perimeter of the turntable. The roller for the rolled material is not claimed as a part of this invention since the rolled material and roller can by supplied from items currently manufactured in the public domain.

The attached drawings clearly describe the operation and parts of the invention wherein.

Figure 1:
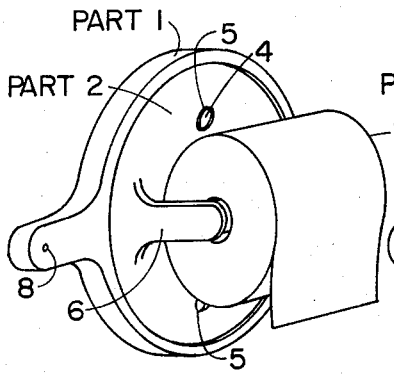
FIGS. 1, 2 and 3 are perspective views of the invention illustrating the operation thereof.
Figure 2:
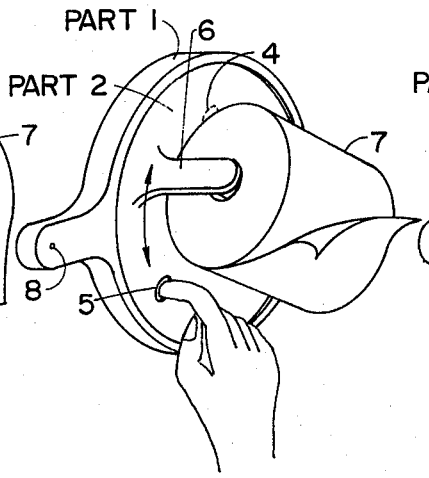
Figure 3:
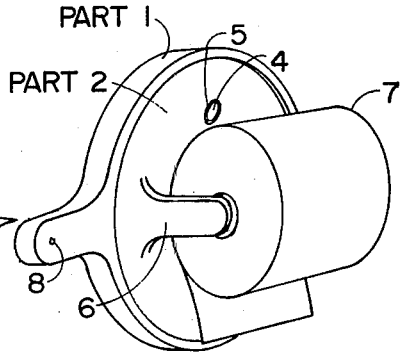
Figure 4:
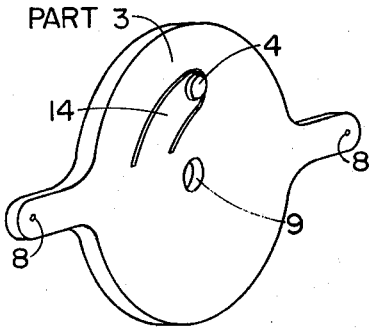
FIGS. 4, 5 and 6 are perspective views of the individual members of the device, respectively.

FIG. 1 shows one position of the turntable, FIG. 2 shows a partial rotation and FIG. 3 shows the reversed dispensing position of the turntable, relative to FIG. 1. Rotation may be made either clockwise or counter-clockwise. FIG. 1 shows the retaining piece, part 1, which can be manufactured from molded plastic, die cast metal or stamped metal which secures in place part 2, the turntable piece, which can be manufactured from molded plastic or die cast metal. FIG. 4 shows the third piece, part 3, which contains as an integral portion, 4, the latching pushbutton, and can be manufactured from molded plastic or stamped metal. The turntable, part 2, is freed to rotate when the pushbutton, 4, is depressed sufficiently to clear part 2. In FIG. 2, the turntable, part 2, is rotated in either clockwise or counter-clockwise direction after depressing pushbotton 4 by applying a dialing pressure to a retaining hole, 5. Rotation is continued until stopped by pushbutton 4 snapping back into the second hole, 5, located one-hundred-eighty degrees opposite in the plane of rotation from the first retaining hole, 5. In FIGS. 1, 2 and 3, it can be seen that the support arms, 6, are reversed by this rotation so that the paper or other rolled material, 7, is caused to unroll in the opposite direction from that of its position before the rotation of part 2 took place. In FIGS. 1, 2 and 3, it is seen that the entire assembly is secured to a wall or other mounting surface by means of screws or other suitable fasteners applied through mounting holes, 8.

Figure 5:
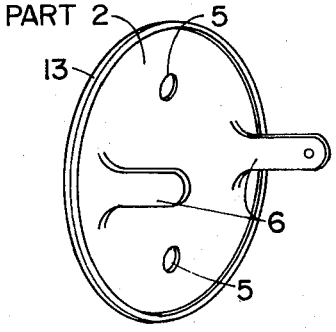
Figure 6:
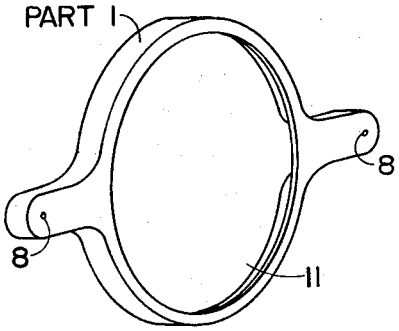
Figure 7:
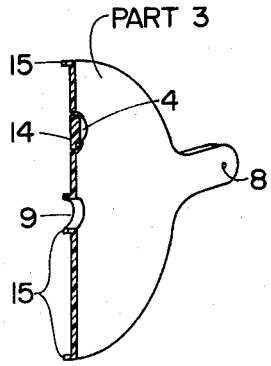
FIGS. 7, 8 and 9 are sectional views of the respective members shown in FIGS. 4, 5 and 6.
Figure 8:
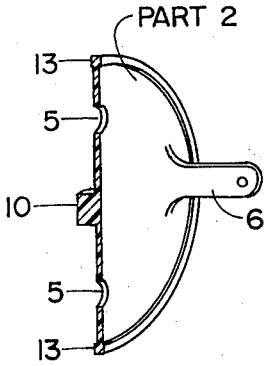
Figure 9:
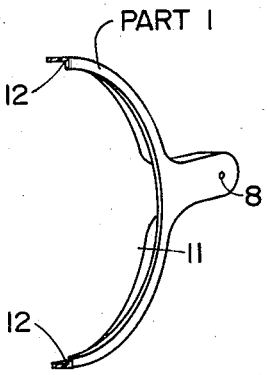
Figure 10:
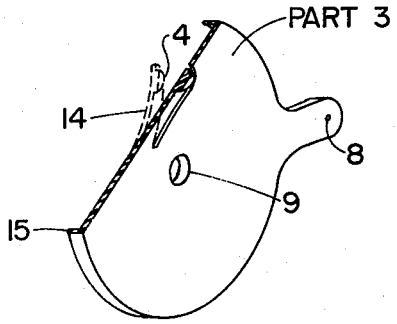
FIG. 10 is a sectonal view of the latching piece shown in FIG. 4 illustrating the operation of the latch button.
Figure 11:
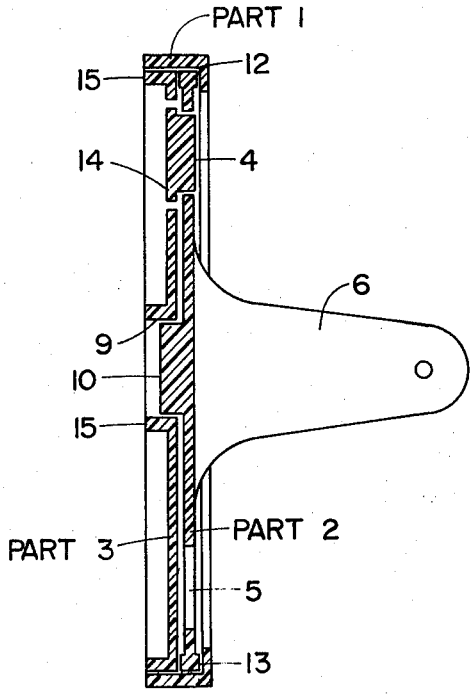
FIGS. 11 and 12 are sectional views ot two different embodiments of the invention in assembled condition.
Figure 12:
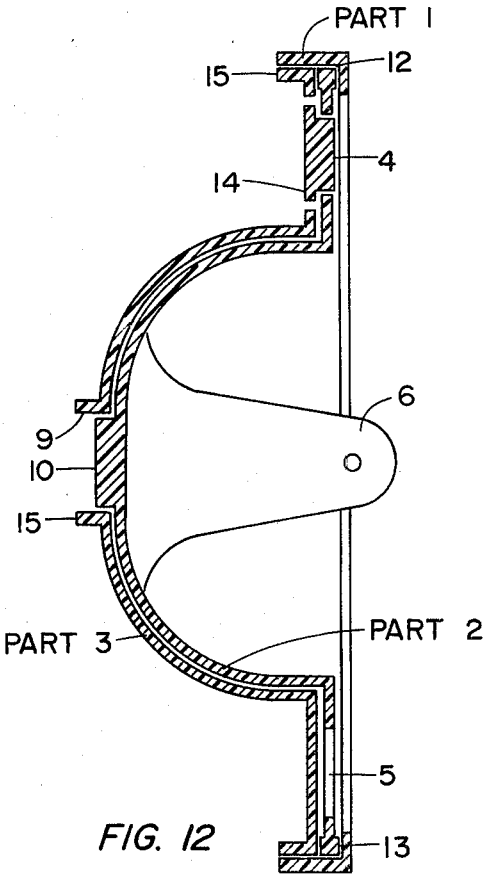

FIGS. 4, 5 and 6 show the three individual parts of the invention separated and ready to assemble. In FIG. 4, the supporting part 3 is seen to contain a bearing hole, 9, into which the spindle, 10, of turntable, part 2, is inserted as the parts are assembled. FIG. 5 shows the turntable, part 2. FIG. 6 shows the retaining piece, part 1, with a large hole, 11, that fits over the support arms, 6, seen as part of the turntable, 2, in FIG. 5, so that when assembled the support arms, 6, protrude freely beyond the other parts and are ready to receive the roller and rolled material. In FIG. 9 a sectional view of the retainer part 1 shows the groove, 12, which laps over turntable part 2 to hold it in place. In FIGS. 5 and 8 turntable part 2 is seen to have a thickened edge, 13, which serves as a bearing to reduce friction by holding the main portion of part 2 separated from parts 1 and 3, facilitating ease of rotation. FIG. 8 is a sectional view of turntable part 2, showing the opposing retaining holes, 5, into which the pushbutton, 4, latches and showing the spindle, 10, about which the turntable rotates when the user dials it into an alternate position. FIG. 7 is a sectional view of the supporting part 3, showing the socket hole, 9, which serves as a bearing and guide for the spindle, 10, of turntable, part 2, and showing the latching pushbutton, 4, which is manufactured as an integral portion of part 3 in the molding or stamping process. Pushbutton 4 is caused to return to its original position by the spring action of arm 14 seen in FIGS. 7 and 4. Latching arm 14 is manufactured as an integral portion of supporting part 3 during the molding or stamping process. In FIG. 7 the supporting part 3 is seen to have thickened edges, 15, which serve to hold it sufficiently far enough away from the wall or other mounting surface to allow for the depression of pushbutton 4 far enough to clear the rotation of turntable part 2. FIG. 10 on sheet 2 of the drawings is a sectional view of supporting part 3 which better illustrates the flexing action of latching arm 14 when the pushbutton, 4, is depressed. FIG. 11 shows a sectional view of all three parts assembled in place as when mounted onto a flat surface such as a wall. FIG. 12 shows the variation in design for the turntable, part 2, and the supporting piece, part 3, to allow for fitting into a niche or depression in the mounting surface, reducing the protrusion of the rolled material outward from the mounting surface. The actions of rotation and latching remain the same whether the mounting surface is flat or niched, and the retaining cover, part 1, is the same except for size, with either mounting.

It is readily apparent that minor variations in arrangement, materials and shape of the parts used are possible without significantly altering the basic utility of the invention, and it should be understood that the following claims are not intended to strictly limit the invention to the exact description and drawings as heretofore presented.

What I claim is new and desire to secure by Letters Patent is:

1. A rotatable dispenser suitable for wall or other surface mounting for holding a roller and toilet paper or other rolled material comprising, a latching member adapted to be fixed to said wall or other surface mounting, a turntable, said turntable having two spaced supporting arms for receiving the roller for the rolled material for rotation about the axis of the roller, means for rotatably supporting said turntable on said latching member for free rotation about an axis perpendicular to the axis of said roller, latch means on said latching member for holding said turntable in a desired dispensing position relative to said latching member and retaining means for holding said latching member and said turntable in assembled position.

2. A rotatable dispenser as defined in claim 1 wherein said latch means comprises a flat spring arm connected to said latching member and a projecting pushbutton on said spring arm engaging one of two holes or notches in said turntable.

3. A rotatable dispenser as defined in claim 2 wherein said flat spring arm is integral with said latching member.

4. A rotatable dispenser as defined in claim 1 wherein said retaining means include a flanged ring member for rotatably receiving siad turntable with said spaced supporting arms projecting through said ring member.

5. A rotatable dispenser as defined in claim 1 wherein said latching member and said turntable are substantially planar for mounting on a substantially flat surface.

6. A rotatable dispenser as defined in claim 1 wherein said latching member and said turntable include concave portions whereby said portions may be received within a recess in said wall or other mounting surface.

* * * * *